US008854373B2

(12) United States Patent
Pessier et al.

(10) Patent No.: US 8,854,373 B2
(45) Date of Patent: Oct. 7, 2014

(54) GRAPH TO ANALYZE DRILLING PARAMETERS

(75) Inventors: Rudolf C. Pessier, Houston, TX (US); Stephen Nicholas Wallace, Oldmeldrum (GB); Hatem Oueslati, Spring, TX (US)

(73) Assignee: Baker Hughes Incorporated, Houston, TX (US)

( * ) Notice: Subject to any disclaimer, the term of this patent is extended or adjusted under 35 U.S.C. 154(b) by 109 days.

(21) Appl. No.: 13/414,810

(22) Filed: Mar. 8, 2012

(65) Prior Publication Data

US 2012/0287134 A1 Nov. 15, 2012

Related U.S. Application Data

(60) Provisional application No. 61/451,216, filed on Mar. 10, 2011.

(51) Int. Cl.

| | |
|---|---|
| ***G06T 11/20*** | (2006.01) |
| ***E21B 44/02*** | (2006.01) |
| ***E21B 45/00*** | (2006.01) |
| ***E21B 44/04*** | (2006.01) |

(52) U.S. Cl.

CPC ..... *E21B 45/00* (2013.01); *E21B 44/02* (2013.01); *E21B 44/04* (2013.01)

USPC ..... 345/440; 715/215

(58) Field of Classification Search

USPC ..... 345/440; 715/215

See application file for complete search history.

(56) References Cited

U.S. PATENT DOCUMENTS

| | | | | |
|---|---|---|---|---|
| 7,243,735 | B2 | 7/2007 | Koederitz et al. | |
| 7,258,175 | B2 | 8/2007 | Veeningen et al. | |
| 7,896,105 | B2 | 3/2011 | Dupriest | |
| 7,991,554 | B2 | 8/2011 | Calhoun et al. | |
| 8,082,104 | B2 | 12/2011 | De Reynal | |
| 2005/0006143 | A1 | 1/2005 | Uitto | |
| 2006/0162962 | A1 | 7/2006 | Koederitz et al. | |
| 2007/0199721 | A1 | 8/2007 | Givens et al. | |
| 2010/0032165 | A1 | 2/2010 | Bailey et al. | |
| 2010/0252325 | A1 | 10/2010 | Porche | |
| 2011/0166837 | A1 * | 7/2011 | Servaes et al. | 703/2 |
| 2011/0214878 | A1 * | 9/2011 | Bailey et al. | 166/369 |
| 2012/0123756 | A1 * | 5/2012 | Wang et al. | 703/2 |
| 2012/0279783 | A1 | 11/2012 | Trinh et al. | |
| 2012/0323495 | A1 | 12/2012 | Zhou et al. | |
| 2013/0032407 | A1 * | 2/2013 | Edbury et al. | 175/61 |

OTHER PUBLICATIONS

International Search Report and Written Opinion dated Oct. 31, 2012 for Application No. PCT/US2012/028496.

(Continued)

*Primary Examiner* — Xiao Wu
*Assistant Examiner* — Todd Buttram
(74) *Attorney, Agent, or Firm* — Cantor Colburn LLP

(57) ABSTRACT

A method for presenting drilling information includes presenting a display including a graph having a first axis and a second axis. The first axis represents a rate of penetration (ROP) of a drill bit into a borehole and the second axis representing a mechanical specific energy (MSE) of a drilling system that includes the drill bit. The method also includes plotting time based or foot based data with a computing device for one or more drilling runs on the graph and overlaying the graph with lines of constant power.

4 Claims, 4 Drawing Sheets

(56) References Cited

OTHER PUBLICATIONS

Pessier, R.C., et al.; Drilling Performance is a Function of Power at the Bit and Drilling Efficiency; IADC/SPE 151389; IADC/SPE Drilling Conference and Exhibition; p. 1-16; 2012.
Total Smart Drilling; "Drilloff Application"; M/D Totco Instrumentation; p. 1-2; 1992.
Total Smart Drilling; "Total Concept"; M/D Totco; p. 1-2; 1992.
Total Smart Drilling; "Visulogger XC"; Mid Totco Instrumentation; p. 1-2; 1993.
Pessier, R.C., et al.; "Quantifying Common Drilling Problems With Mechanical Sepcific Energy and a Bit-Specific Coefficient of Sliding Friction"; SPE 24584; Society of Petroleum Engineers Inc.; p. 373-388; 1992.
SPE; "Computer-Enhanced Drill-Off Testing: A Drilling Performance Tool"; SPE Gulf Coast Area Meeting and Exhibition; p. 1-3; 1993.
Curry, D., et al.; "Technical Limit Specific Energy—An Index to Facilitate Drilling Performance Evaluation"; SEP/IADC 92318; SPE/IADC Drilling Conference; p. 1-8; 2005.
Caicedo, Hector U., et al.; "Unique ROP Predictor Using Bit-specific Coefficient of Sliding Friction and Mechanical Efficiency as a Function of Confined Compressive Strength Impacts Drilling"; SPE/IADC 92576; SPE/IADC Drilling Conference; p. 1-19; 2005.
Waugman, R.J., et al.; "Real-Time Specific Energy Monitoring Reveals Drilling Inefficiency and Enhances the Understanding When to Puo Worn PDC Bits"; IADC/SPE 74520; IADC/SPE Drilling Conference; p. 1-14; 2002.
Dupriest, F.E, et al.; "Maximizing Drill Rates with Real-Time Surveillance of Mechanical Specific Energy"; SPE/IADC 92194; SPE/IADC Drilling Conference; p. 1-10; 2004.
Notification of Transmittal of the International Preliminary Report on Patentability of the International Searching Authority, or the Declaration; PCT/US2012/028496; Sep. 19, 2013.
Krall et al., "New drilling process increases rate of penetration, footage per day", Offshore, Jan. 2006, pp. 58-61.

* cited by examiner

GRAPH TO ANALYZE DRILLING PARAMETERS

PRIORITY CLAIM AND RELATED APPLICATIONS

This application claims priority under 35 U.S.C. 119(e) to U.S. Provisional Patent Application No. 61/451,216, filed Mar. 10, 2011, entitled "GRAPH TO ANALYZE DRILLING PARAMETERS" and which is incorporated herein by reference in its entirety.

BACKGROUND

1. Field of the Invention

The present invention generally relates to drilling boreholes and, particularly, to a graph that can be used to analyze drilling performance.

2. Description of the Related Art

Boreholes are drilled into the earth for many applications such as hydrocarbon production, geothermal production and carbon dioxide sequestration. A borehole is drilled with a drill bit or other cutting tool disposed at the distal end of a drill string. A drilling rig turns the drill string and the drill bit to cut through formation rock and, thus, drill the borehole.

An ideal drilling situation would involve perfect power transfer from the surface to the drill bit. Of course, this is not possible. However, variation of different parameters can affect how well power is transferred. At present, however, there is not a simple way to determine the effects of parameter variation on energy transfer efficiency. The power delivered to the drill bit is directly proportional to the rate of penetration and the key parameter influencing the cost and overall economics of drilling a bore hole.

BRIEF SUMMARY

Disclosed is a method for presenting drilling information that includes: presenting a display including a graph having a first axis and a second axis, the first axis representing a rate of penetration (ROP) of a drill bit into a borehole and the second axis representing a mechanical specific energy (MSE) of a drilling system that includes the drill bit; and plotting time based or foot based data with a computing device for one or more drilling runs on the graph and overlaying the graph with lines of constant power.

Also disclosed is an article of manufacture including computer usable media, the media having embodied therein computer readable program code means for causing a computing device to perform a method comprising: presenting a display including a graph having a first axis and a second axis, the first axis representing a rate of penetration (ROP) of a drill bit into a borehole and the second axis representing a mechanical specific energy (MSE) of a drilling system that includes the drill bit; and plotting time based or foot based data with a computing device for one or more drilling runs on the graph overlaying the graph with lines of constant power.

BRIEF DESCRIPTION OF THE DRAWINGS

The following descriptions should not be considered limiting in any way. With reference to the accompanying drawings, like elements are numbered alike.

DETAILED DESCRIPTION

A detailed description of one or more embodiments of the disclosed apparatus and method presented herein is by way of exemplification and not limitation with reference to the Figures.

For convenience, certain definitions are provided. The term "drill string" relates to at least one of drill pipe and a bottom hole assembly (BHA). In general, the drill string includes a combination of the drill pipe and a BHA. The BHA may be a drill bit, sampling apparatus, logging apparatus, or other apparatus for performing other functions downhole. As one example, the BHA can include a drill bit and a drill collar containing measurement while drilling (MWD) apparatus. The MWD apparatus can measure, for example, the torque experienced by the drill bit with a sensor.

The term "sensor" relates to a device for measuring at least one parameter associated with the drill string. Non-limiting examples of types of measurements performed by a sensor include acceleration, velocity, distance, angle, force, torque, momentum, temperature, pressure, bit RPM and vibration. As these sensors are known in the art, they are not discussed in any detail herein.

Figure 1:
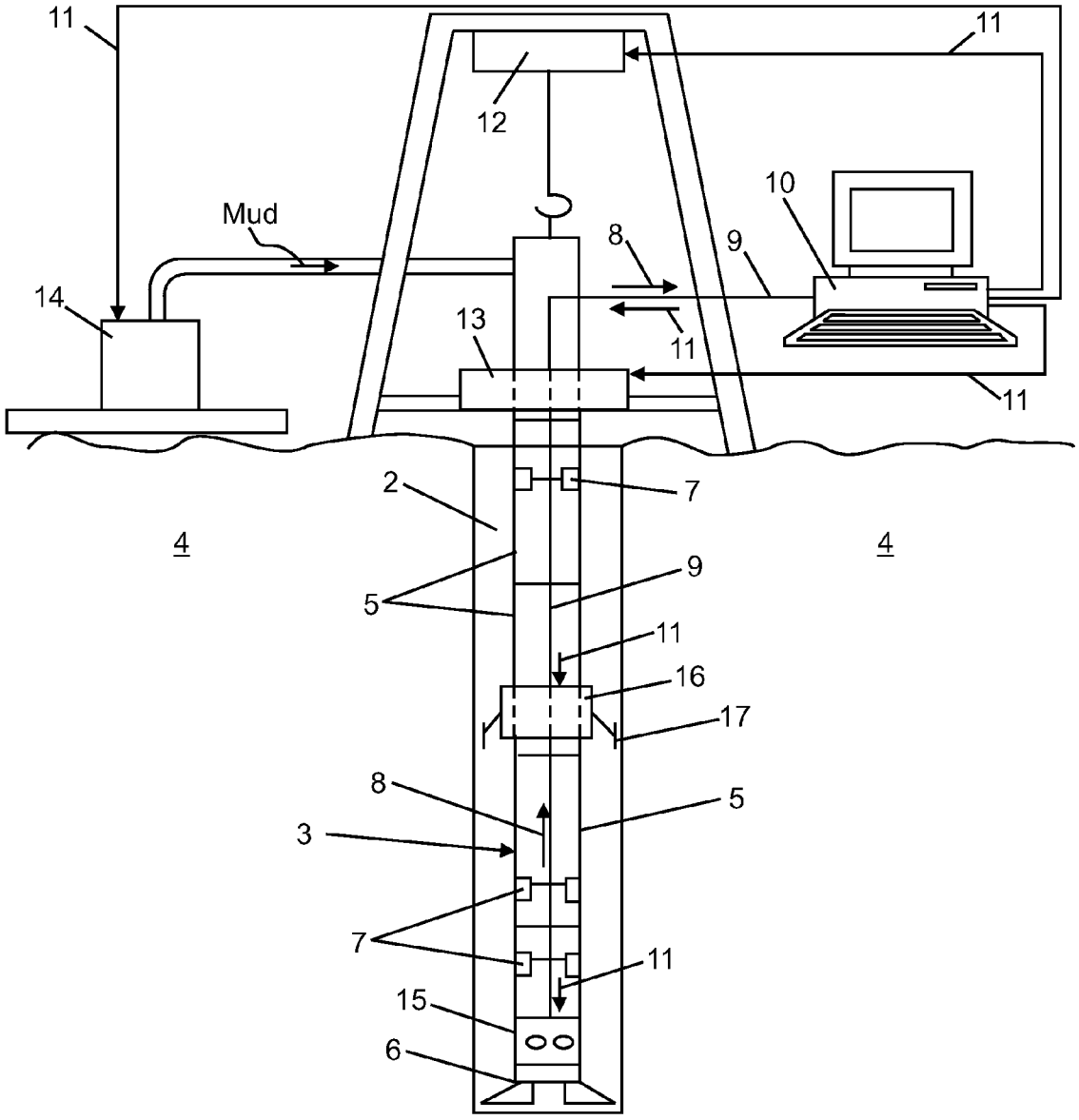
FIG. 1 illustrates an exemplary embodiment of a drill string disposed in a borehole penetrating the earth.

FIG. 1 illustrates an exemplary embodiment of a drill string 3 disposed in a borehole 2 penetrating the earth 4. The borehole 2 can penetrate a geologic formation that includes a reservoir of oil or gas or geothermal energy. The drill string 3 includes drill pipe 5 and a BHA 6. The bottom hole assembly 6 can include a drill bit or other drilling device for drilling the borehole 2.

In the embodiment of FIG. 1, a plurality of sensors 7 is disposed along a length of the drill string. The sensors 7 measure aspects related to operation of the drill string 3, such as motion of the drill string 3 or torque experienced at the drill bit portion of the BHA 6. A communication system 9 transmits data 8 from the sensors 7 to a controller 10. The data 8 includes measurements performed by the sensors 7. It shall be understood that in one embodiment, the data 8 can be processed before being transmitted. As such, the data 8 can include processed data or diagnostic information. Furthermore, in such an embodiment, the drill string 3 may included a processor located at or near the BHA 6 to provide such processing of the data before it is transmitted. The controller 10 can be implemented on any type of computing device and can include data storage capabilities for storing received data. The controller 10 can be located at the drilling location or a different location.

In one embodiment, the communication system 9 can include a fiber optic or "wired pipe" for transmitting the data 8. Of course, the communication system 9 can be implemented in different ways. For example, the communication system 9 could be a mud-pulse telemetry system in one embodiment.

Various drill string motivators may be used to operate the drill string 3. The drill string motivators depicted in FIG. 1 include a lift system 12, a rotary device 13, a mud pump 14, a flow diverter 15, and an active vibration control device 16. Each of the drill string motivators depicted in FIG. 1 are coupled to the controller 10. The controller 10 can provide a control signal 11 to one or each of these drill string motivators to control at least one aspect of their operation. For example, the control signal 11 can cause the lift system 12 to impart a certain force on the drill string 3. Such a force typically changes an operating parameter referred to as "weight-on-bit" (WOB).

The controller 10 can also provide control signals 11 to the rotary device 13 to control at least one of the rotational speed of the drill string 3 and the torque imposed on the drill string 3 by the rotary device 13. In some cases, the controller 10 can also provide control signals 11 to control the flow of mud from the mud pump 14, the amount of mud diverted by the flow diverter 15 and operation of the active vibration control device 16.

The example in the previous paragraph assumes automated control of the drill string 3 by the controller 10. Such automated control is not required. As such, in one embodiment, an operator is provided with a display of operating conditions. The operator then causes the controller 10 to change the operation of the drill string 3 by manually changing set points or other parameters as is know in the art.

While drilling or during post drilling evaluations, there are many types of displays that can be generated based on the information provided by the sensors 7 as well as the operating parameters of one or more of drill string motivators. These displays, however, can sometimes fail to disclose important information that can be used to improve the drilling process. For example, the effects of varying WOB or torque on the rate of penetration (ROP) of the bit may not be clear from these displays due to the frictional losses and vibrations in the drill string 3 and the BHA 6.

Embodiments of the present invention are directed to a display that can be used to assess, in either real time or after the fact, drilling performance. The display includes a graph having a rate of penetration on one axis and a mechanical specific energy (MSE) on another. In some cases, the display can include power curves of different input powers (e.g. horse power transmitted by the rotary device 13 to the drill string 3) overlaid upon it. The display can be provided either through an electronic displaying device (e.g., a computer monitor) or by printing the display to a tangible medium such as paper, or both.

Figure 2:
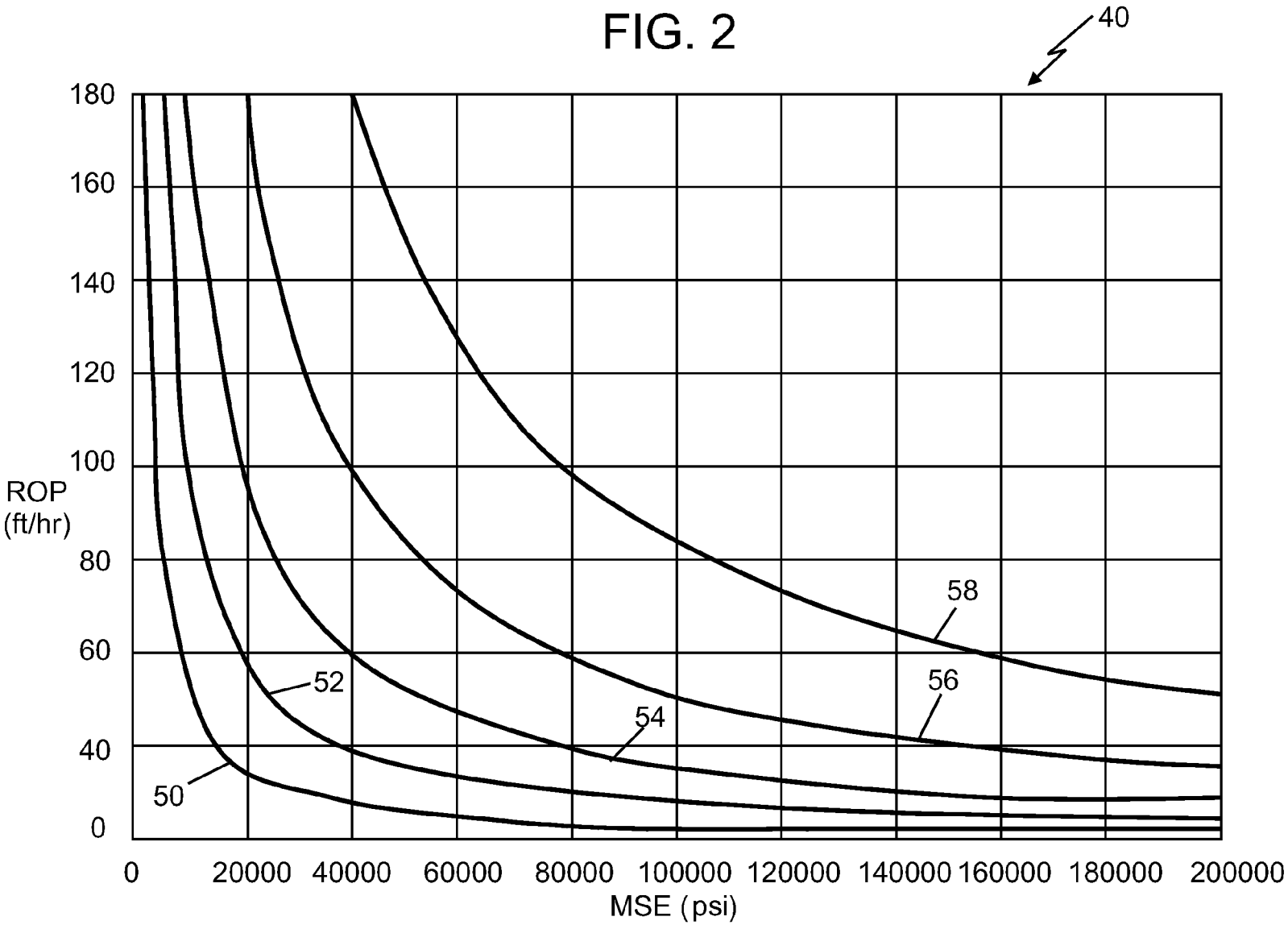
FIG. 2 illustrates a display including a graph according to one embodiment.

FIG. 2 illustrates a display 40 that includes a first axis 42 and a second axis 44. As depicted, the first axis 42 a mechanical specific energy (MSE) axis and is illustrated in units of pounds per square inch (psi) and the second axis 44 is a rate of penetration (ROP) expressed in feet per hour. Of course, the first and second axes 42, 44 could be reversed and the particular units could be changed depending on the circumstances. Plotting ROP versus MSE can, in some instances, take into account the power delivered to the drill string and how efficiently it is being used in the drilling process. Indeed, such a plot can provide a tool that can be utilized in well planning, after action review and real time monitoring of drilling performance.

The rate of penetration of a drill bit and drill string 3 is easily measured while drilling and is known in the art. In some cases, the rate of penetration (ROP) is measured as a function of the depth and generally averaged for each foot as the borehole is drilled. Such data is included in so-called "foot based data." Of course, ROP could be measured and recorded based on time and referred to as "time based data."

A drill string can be modeled as a cylinder being rotated against a flat surface. The torque at the end of the drill string 3 (T) in such a model can be expressed as shown in equation 1:

$$T = \mu \cdot \frac{DW}{36} \tag{1}$$

where μ is the coefficient of friction between the bottom of the cylinder and the flat surface, D is the diameter of the cylinder (e.g., the diameter of the drill bit) expressed in inches and W is the WOB expressed, for example, in pounds. Of course, W can include the weight of the drill pipe and any weight provided, for example, by the lift system 12 (FIG. 1) or by other portions of the drill string.

The mechanical specific energy (MSE), as the term is used herein, is defined as the work expended per unit volume of rock removed during drilling. In the case where the torque provided to the drill string 3 can be measured, the MSE can be expressed as shown in equation 2:

$$MSE = \frac{W}{A} + \frac{120\pi TN}{A \cdot ROP} \tag{2}$$

where T is the torque provided to the drill string expressed in ft-lbs, N is the rotations per minute (RPM), A is the area of the hole expressed in $in^2$ and ROP is expressed in ft/hr. For simplicity, in equation 2 and the following equation 3, the W/A term can be ignored as it is dominated by the second term. Further, utilizing the relationship between torque and μ in equation 1 can allow equation 2 to be expressed in terms of W and μ in the event that the torque provided to the drill string is not available and as is shown in equation 3:

$$MSE = \frac{13.33\mu WN}{D \cdot ROP} \tag{3}$$

In one embodiment, the display 40 includes one or more power curves 50, 52, 54, 56, and 58. The power curves can be created by equating ROP to MSE in equation 2 and selecting different values for T. In one embodiment, T is expressed in horse power (Hp) provided to the drill string by rotary device 14 (FIG. 1) according to the relationship of equation 4 for rotating objects:

$$HP = \frac{TN}{5252} \tag{4}$$

In FIG. 2, power curve 50 is calculated with HP=10, power curve 52 is calculated with HP=25, power curve 54 is calculated with HP=50, power curve 56 is calculated with HP=100, and power curve 58 is calculated with HP=200. Of course, power curves could be created at other levels.

It shall be understood that MSE can serve as a proxy for efficiency. That is, the lower the MSE, the more efficiently power is transferred from the surface to the drill bit.

Figure 3:
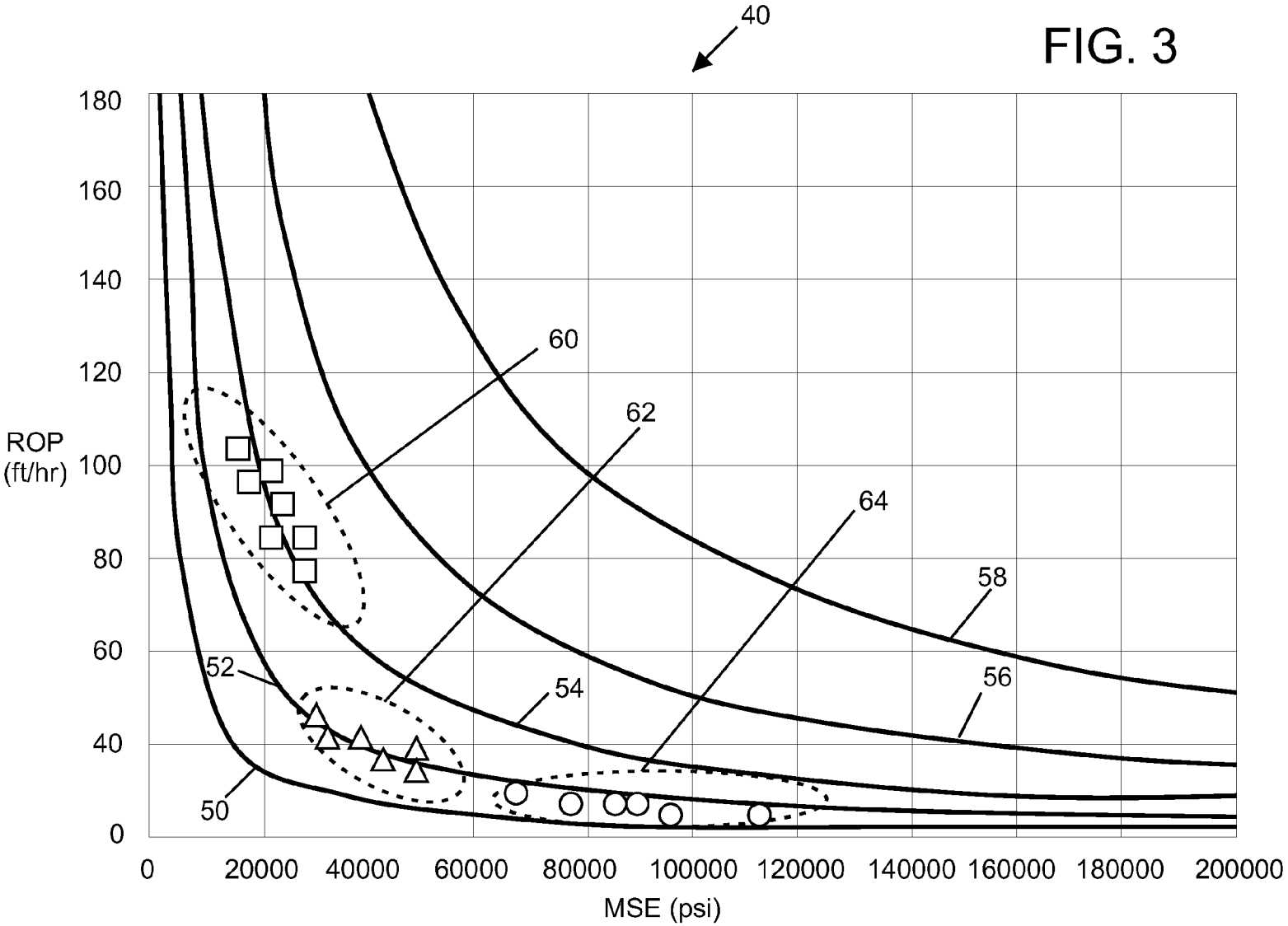
FIG. 3 illustrates a display having data points from three different drilling runs plotted thereon.

FIG. 3 is a plot on the graph 40 of FIG. 2 of example foot based data taken from three different drilling runs 60, 62, 64 in the same or similar location. All three drilling runs 60, 62, 64 had the same RPM. Each of the drilling runs 60, 62, 64 has a different WOB. In this example, the WOB for drilling run 60 was 30,000 pounds force (lbf), the WOB for drilling run 62 was 10,000 lbf, and the WOB for drilling run 64 was 5,000 lbf. The plot in FIG. 3 illustrates that doubling the WOB (from 5 klbf to 10 klbf) increases ROP and efficiency while requiring a negligible increase in Hp provided to the drill string. Further, increasing the WOB three fold (from 10 klbf to 30 klbf) resulted in 2-4 times increased ROP while also doubling efficiency. In this case, the Hp provided to the drill string 3 only had to double (from 25 Hp to 50 Hp).

Figure 4:
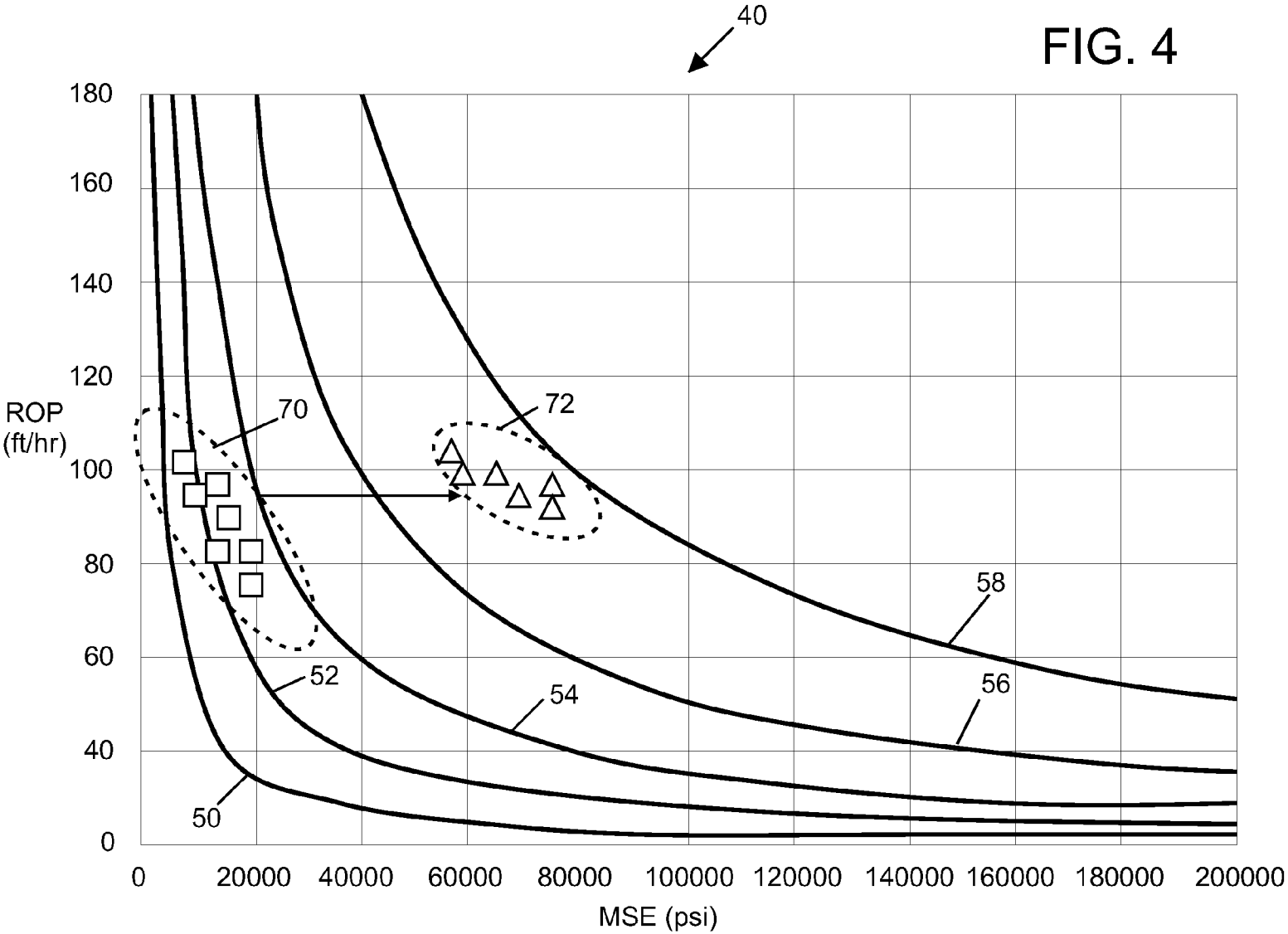
FIG. 4 is a plot of data sets that represent levels of power provided at the surface and the power delivered to the drill bit.

FIG. 4 is a plot of the graph 40 of FIG. 2 showing data sets 70 and 72 that represent the torque provided at the surface (data set 72) and the torque experienced at the drill bit (data set 70). As can be seen, there is a substantial amount of power lost in the drill string 3 between the surface and the bit. Repeating the plot for several different input powers and resulting power at the bit can provide insight that can help plan the amount of power to provide at certain depths to balance efficiency of drilling with power input.

Similar comparisons can be made for bit wear over time where, in real time, a drop in ROP at a similar MSE can indicate that the bit is becoming dull. In addition, the graph 40 can be used to determine the type of rock being traversed by comparing a particular ROP and input Hp to a plot of prior ROP and input Hp plots of data from drilling locations having known formation components (e.g., test sites).

It shall be understood that any graph, whether in two or three dimensions that includes axis as described herein fall within the scope of the present invention. Further in shall be understood that in some instances the data used in these graphs can be gathered from other locations in the drill string. For instance, the torque could be measured a location at or near the BHA rather than at the surface to provide, for example, information related to the efficiency of the drill bin.

As one example, one or more aspects of the present invention can be included in an article of manufacture (e.g., one or more computer program products) having, for instance, computer usable media. The media has embodied therein, for instance, computer readable program code means for providing and facilitating the capabilities of the present invention. The article of manufacture can be included as a part of a computer system or sold separately.

Elements of the embodiments have been introduced with either the articles "a" or "an." The articles are intended to mean that there are one or more of the elements. The terms "including" and "having" are intended to be inclusive such that there may be additional elements other than the elements listed. The conjunction "or" when used with a list of at least two terms is intended to mean any term or combination of terms. The terms "first," "second," and "third" are used to distinguish elements and are not used to denote a particular order.

It will be recognized that the various components or technologies may provide certain necessary or beneficial functionality or features. Accordingly, these functions and features as may be needed in support of the appended claims and variations thereof, are recognized as being inherently included as a part of the teachings herein and a part of the invention disclosed.

While the invention has been described with reference to exemplary embodiments, it will be understood that various changes may be made and equivalents may be substituted for elements thereof without departing from the scope of the invention. In addition, many modifications will be appreciated to adapt a particular instrument, situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A method for presenting drilling information comprising:

presenting a display including a graph having a first axis and a second axis, the first axis representing a rate of penetration (ROP) of a drill bit into a borehole and the second axis representing a mechanical specific energy (MSE) of a drilling system that includes the drill bit;

plotting time based or foot based data with a computing device for one or more drilling runs on the graph; and overlaying the graph with lines of constant power;

wherein MSE is equal to work expended per unit volume of rock removed during drilling; and wherein MSE is defined by the following relationship:

$$MSE = \frac{13.33\mu WN}{D \cdot ROP}$$

where μ is the coefficient between an end of the drill string and the rock, W is the weight on bit, N is the rotations per minute of the drill string, and D is the diameter of the borehole.

2. The method of claim 1, further comprising:

printing the display to a tangible medium.

3. The method of claim 1, further comprising:

adjusting at least one of the weight on bit, rotations per minute of the drill string, or the power provided to the drill string.

4. An article of manufacture including a non-transitory computer usable media, the media having embodied therein computer readable program code means for causing a computing device to perform a method comprising:

presenting a display including a graph having a first axis and a second axis, the first axis representing a rate of penetration (ROP) of a drill bit into a borehole and the second axis representing a mechanical specific energy (MSE) of a drilling system that includes the drill bit; and plotting time based or foot based data with a computing device for one or more drilling runs on the graph; and overlaying the graph with lines of constant power;

wherein MSE is equal to work expended per unit volume of rock removed during drilling; and wherein MSE is defined by the following relationship:

$$MSE = \frac{13.33\mu WN}{D \cdot ROP}$$

where μ is the coefficient between an end of the drill string and the rock, W is the weight on bit, N is the rotations per minute of the drill string, and D is the diameter of the borehole.

* * * * *